US005634409A

United States Patent [19]

Pagett

[11] Patent Number: 5,634,409

[45] Date of Patent: Jun. 3, 1997

[54] CORNER DESK FOR COMPUTER AIDED DESIGN

[76] Inventor: Michael G. Pagett, 88 Cottage St., Trumbull, Conn. 06611-2830

[21] Appl. No.: 274,288

[22] Filed: Jul. 13, 1994

[51] Int. Cl.[6] ..... A47B 5/00

[52] U.S. Cl. ..... 108/48; 312/238; 108/64

[58] Field of Search ..... 108/64, 48, 185, 108/187, 188, 156; 312/238

[56] References Cited

U.S. PATENT DOCUMENTS

| | | | |
|---|---|---|---|
| 2,658,810 | 11/1953 | Ellis et al. | 312/238 |
| 4,400,045 | 8/1983 | Baschin | 312/238 |

OTHER PUBLICATIONS advertisement by Mayline/Hamilton, Sheboygan WI, 1991.
Advertisement by Hon. Date unknown.
Advertisement by M&M. Date unknown.
Advertisement by Marvel. Date unknown.

*Primary Examiner*—Peter M. Cuomo
*Assistant Examiner*—Gerald A. Anderson
*Attorney, Agent, or Firm*—John H. Crozier

[57] ABSTRACT

In a preferred embodiment, a corner desk for a computer aided design system, including: a horizontal, upper working surface having a lower surface and a substantially flush upper surface; and a supporting structure attached to and disposed beneath the upper working surface, the supporting structure having no members thereof which extend into a space defined by the lower surface of the upper working surface and distal corners of the supporting structure.

2 Claims, 4 Drawing Sheets

CORNER DESK FOR COMPUTER AIDED DESIGN

BACKGROUND OF THE INVENTION

1. Field of the Invention

The present invention relates to furniture for computer workstations generally and, more particularly, but not by way of limitation, to a novel heavy duty corner desk for a computer aided design system.

2. Background Art

Computer aided design (CAD) has become more and more widely used in a variety of applications. It offers accuracy, flexibility, and the ability to rapidly make changes to designs.

Furniture for CAD systems has typically evolved into providing a central area in which a computer/keyboard/CRT unit is located, a first side area on which a printer is installed, the printer being of such size that fairly large drawings may be printed, and a second side area which is relatively free of equipment and which is used to spread out drawings and other materials for study, checking, etc. The most efficient layout for such an arrangement is an L-shaped corner desk with the computer equipment in the central corner portion of the work surface of the desk.

A number of such L-shaped workstations have been developed for CAD systems. Some designs have the disadvantage of having structural support members disposed in the space under the upper work surface. This is a problem because the operator of the CAD system usually must frequently slide back and forth along the work surface in a swivel chair and structural support members interfere with the legs of the chair. Other designs have the disadvantage of having a multilevel work surface. This is a problem because drawings and other materials must often be slid along the work surface and discontinuities make this difficult. Also, having a multilevel work surface means that some portion(s) of the work surface will not be at an optimum height. Many designs are of very light construction. This is a problem for many reasons, one of which is that often one or more people may be leaning or sitting on the edge of the desk studying drawings or the CRT.

Accordingly, it is a principal object of the present invention to provide a workstation for CAD which has a flush upper work surface.

It is a further object of the present invention to provide such a workstation that has no supporting structure in the space below the upper work surface except at distal corners thereof.

It is an additional object of the present invention to provide such a workstation that is sturdily constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a corner desk for a computer aided design system, comprising: a horizontal, upper working surface having a lower surface and a substantially flush upper surface; and a supporting structure attached to and disposed beneath said upper working surface, said supporting structure having no members thereof which extend into a space defined by said lower surface of said upper working surface and distal corners of said supporting structure.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
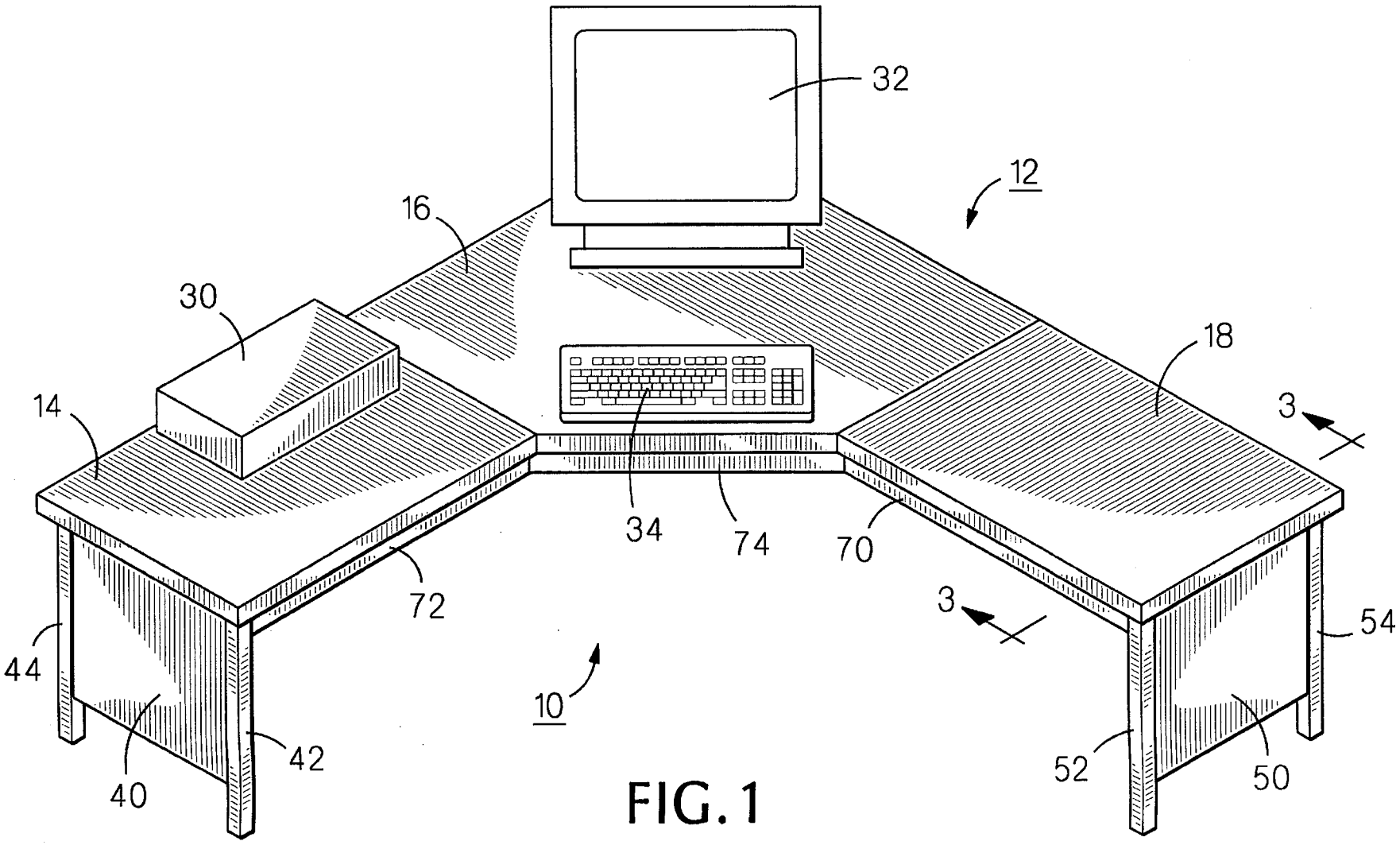
FIG. 1 is isometric view of a corner desk constructed according to the present invention, with CAD equipment placed thereon.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a corner desk for CAD, constructed according to the present invention, generally indicated by the reference numeral 10.

Desk 10 has a flush, horizontal upper work surface, generally indicated by the reference numeral 12, the work surface comprising adjoining left panel 14, central panel 16, and right panel 18. Disposed on left panel 14 is a printer 30 and disposed on center panel 16 is a CRT/computer 32 and a keyboard 34 associated therewith. Right panel 18 has no equipment disposed thereon to provide a surface for the placement thereon of drawings. It can be seen that flush surface 12 is broad and unobstructed so that drawings and other materials may be easily relocated therealong. Keyboard 34 may be easily relocated a greater or lesser distance to other locations on work surface 12 as desired.

Figure 2:
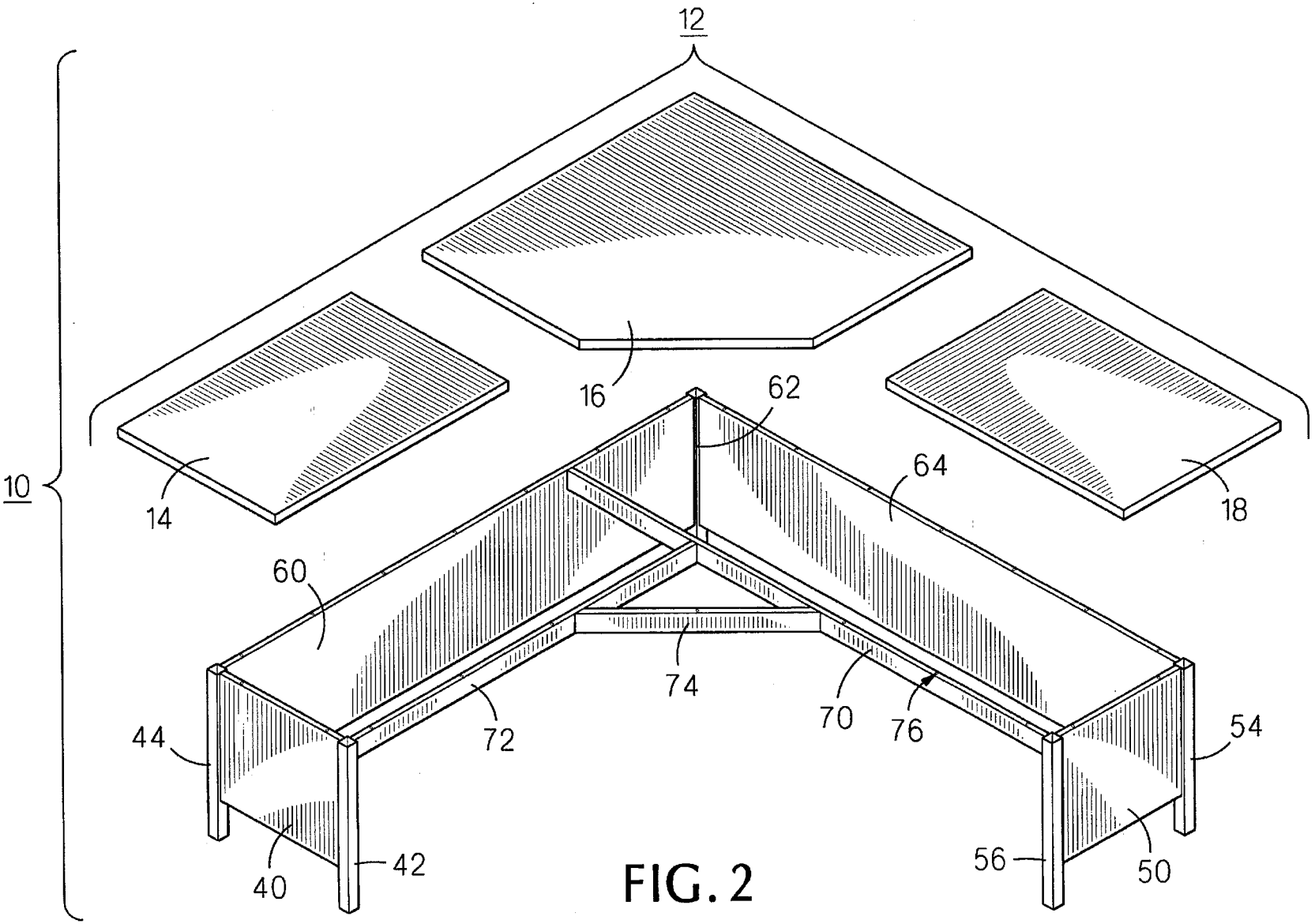
FIG. 2 is a partially exploded isometric view of the corner desk of FIG. 1.

Reference should now primarily be made to FIG. 2 for an understanding of the construction of desk 10. The left distal end of desk 10 terminates with a vertical, left end panel 40 attached to and extending between front and rear vertical legs 42 and 44, respectively. The right distal end of desk 10 terminates with a vertical, right end panel 50 attached to and extending between front and rear vertical legs 52 and 54. A vertical, left rear panel 60 is attached to and extends between left rear leg 44 and a vertical, inside corner leg 62 and a vertical, right rear panel 64 is attached to and extends between the inside corner leg and right rear leg 54. Legs 42, 44, 52, 54, and 62 are preferably formed from 1½-inch square, 16-gauge, cold rolled steel.

Structural support for flush surface 12 is provided as follows: A first, upper, front rail 70 is attached to and extends, parallel to right rear panel 64, between the upper end of right front leg 52 and the upper edge of left rear panel 60. A second, upper, front rail 72 is attached to and extends, parallel to left rear panel 60, the upper end of right front leg 42 and an intermediate point on first, upper, front rail 70. A third, upper, front rail 74 is attached to and extends, at an angle to, between first and second upper front rails 70 and 72, respectively, at intermediate points between ends thereof. Front rails 70, 72, and 74 are preferably 1 inch by 3 inch channels formed from 16-gauge cold rolled steel.

Figure 3:
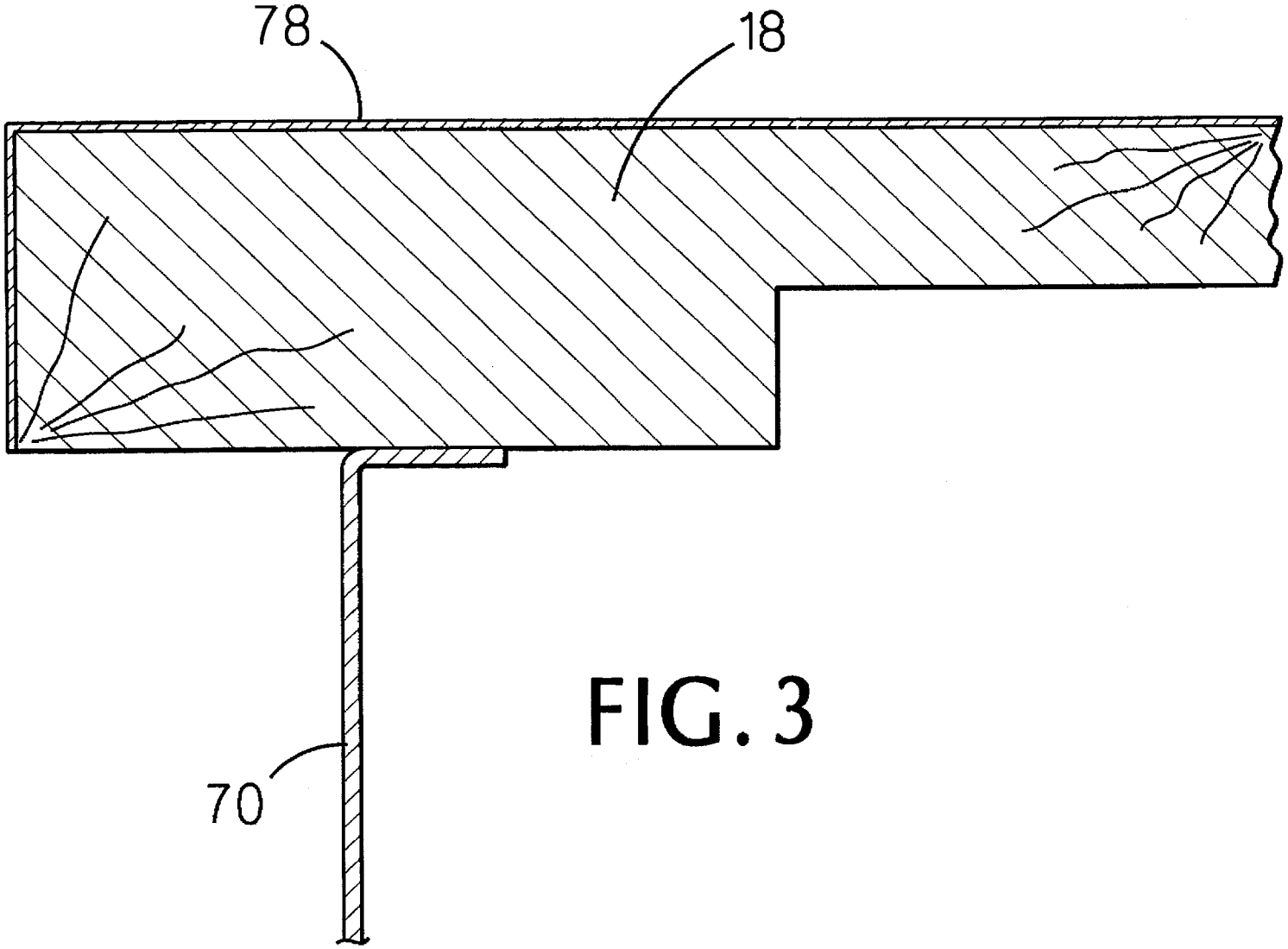
FIG. 3 is a fragmentary cross-sectional view taken along line "3—3" of FIG. 1.

As can be seen on FIG. 1, panels 14, 16, and 18 of upper work surface 12 are attached, respectively, to upper front rails 72, 74, and 70 such that the front rails are disposed in proximity to the front edges of the panels. This is shown more clearly on FIG. 3. Panel 18 is formed from ¾-inch thick, 30-inch wide, industiral grade particleboard, with a ¾-inch thick, 3½-inch wide built-up reinforcing portion disposed along the front edge thereof to which front rail 70 is attached by means of screws (not shown) inserted through holes, as at 76 (FIG. 2). Front rail 70 is set back from the front edge of panel 18 about 1½ inches. A plastic laminate layer 78 covers the upper and front surfaces of panel 18. The arrangement of front rails 72 and 74 with panels 14 and 16, respectively, is similar.

It can be seen that desk 10 has a sturdy supporting structure and that the front edges of upper working surface 12 can easily support persons leaning or sitting thereon.

It can be seen also that there is no supporting structure extending into the open space defined by the lower surface of upper working surface 12, left and right end panels 40 and 50, respectively, and left and right rear panels 60 and 64, respectively.

Figure 4:
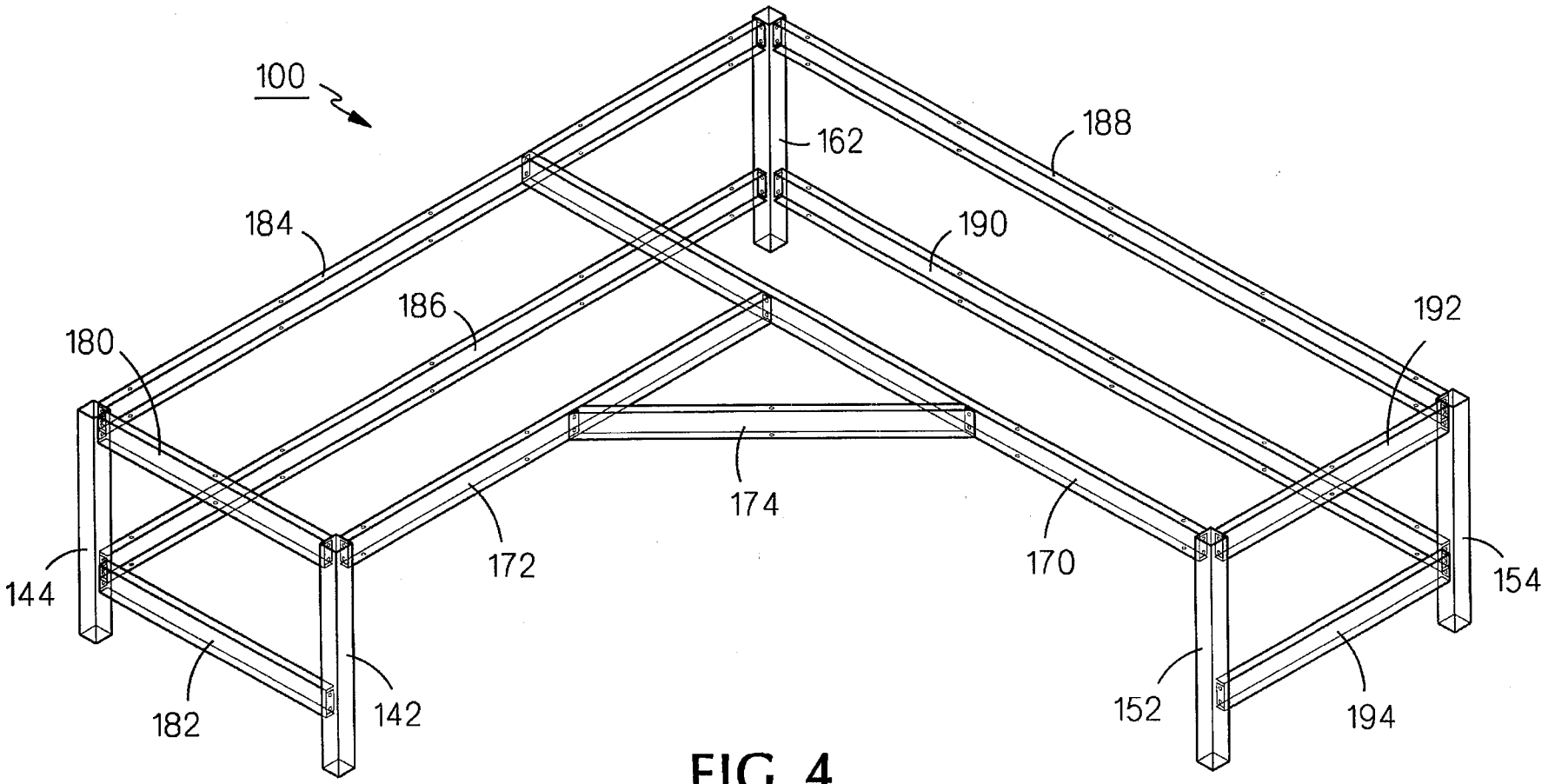
FIG. 4 is a cut-away view of an alternative embodiment of the present invention.

FIG. 4 illustrates and alternative embodiment of desk 10, without panels, generally indicated by the reference numeral 100, shown here without an upper working surface; however, it will be understood that a working surface identical to that described above with reference to FIGS. 1–3 would be provided. Desk 100 includes front and rear left legs 142 and 144, respectively, an inside corner leg 162, front and rear right legs 152 and 154, and upper front rails 170, 172, and 174, all of which are similar to the like members of desk 10 on FIGS. 1–3.

Desk 100 further includes upper and lower left end rails 180 and 182, respectively, attached to and extending between front and rear legs 142 and 144; upper and lower rear rails 184 and 186, respectively, attached to and extending between rear leg 144 and corner leg 162; upper and lower rear rails 188 and 190, respectively, attached to and extending between the inside corner leg and rear leg 154; and upper and lower right end rails 192 and 194, respectively, attached to and extending between front and rear legs 152 and 154.

Desk 100 has the same advantages of desk 10, but has a somewhat sturdier supporting structure.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A corner desk for a computer aided design system, comprising:

(a) a horizontal, upper working surface having a lower surface and a substantially planar upper surface; and (b) a supporting structure attached to and disposed beneath said upper working surface, said supporting structure comprising:

(i) a first end terminating in a vertical, first end panel attached to and extending between vertical, first front and rear legs;

(ii) a second end terminating in a vertical, second end panel, orthogonal to said first end panel, attached to and extending between vertical, second front and rear legs;

(iii) a vertical, first rear panel attached to and extending between said first rear leg and a vertical, inside corner leg;

(iv) a vertical, second rear panel, orthogonal to said first rear panel, attached to and extending between said inside corner leg said second rear leg;

(v) a first, upper, front rail attached to and extending, parallel to said second rear panel, between an upper end of said second front leg and an upper edge of said first rear panel;

(vi) a second, upper, front rail attached to and extending, parallel to said first rear panel, between an upper end of said first front leg and an intermediate point on said first upper front rail;

(vii) a third, upper, front rail attached to and extending, at an angle to, between said first and second upper front rails;

(viii) said first, second, and third front rails being disposed in proximity to front edges of said upper working surface.

2. A corner desk for a computer aided design system, comprising:

(a) a horizontal, upper working surface having a lower surface and a substantially planar upper surface; and (b) a supporting structure attached to and disposed beneath said upper working surface, said supporting structure comprising:

(i) vertical first front and rear left legs, a vertical inside corner leg, and vertical second front and rear legs;

(ii) horizontal first upper and lower left end rails, attached to and extending between said first front and rear legs; horizontal second upper and lower rear rails, attached to and extending between said first rear leg and said inside corner leg; horizontal first upper and lower rear rails, attached to and extending, orthogonal to said first rear rails, between said inside corner leg and said first rear leg; and upper and horizontal second lower right end rails, attached to and extending, parallel to said first end rails, between said second front and rear legs;

(iii) a first, upper, front rail attached to and extending, parallel to said second rear rails, between an upper end of said second front leg and said first upper rear rail;

(iv) a second, upper, front rail attached to and extending, parallel to said first rear rails, between an upper end of said first front leg and an intermediate point on said first, upper, front rail;

(v) a third, upper, front rail attached to and extending, at an angle to, between said first and second upper front rails intermediate ends of said first and second upper front rails;

(vi) said first, second, and third front rail being disposed in proximity to front edges of said upper working surface.

* * * * *